US005551578A

United States Patent [19]

McCue et al.

[11] Patent Number: 5,551,578

[45] Date of Patent: Sep. 3, 1996

[54] SHOPPING CART STORAGE AND CONTROL STATION

[75] Inventors: David S. McCue, Marblehead, Mass.; Roland M. Gebhardt, New York, N.Y.

[73] Assignee: McCue Corporation, Salem, Mass.

[21] Appl. No.: 281,757

[22] Filed: Jul. 28, 1994

[51] Int. Cl.[6] ..... A47F 7/00

[52] U.S. Cl. ..... 211/17; 211/22; 256/1

[58] Field of Search ..... 211/5, 17, 20, 211/22; 256/1, 64; 135/118, 119, 120.1, 120.2; 194/905; 52/798.1

[56] References Cited

U.S. PATENT DOCUMENTS

| | | | |
|---|---|---|---|
| 3,481,643 | 12/1969 | Campbell | 52/798.1 X |
| 3,633,327 | 1/1972 | Klingensmith et al. | 52/798.1 X |
| 3,950,873 | 4/1976 | Stehle et al. | 256/64 X |
| 4,236,697 | 12/1980 | Savino | 256/1 |
| 4,424,893 | 1/1984 | Gillet | 194/905 X |
| 4,609,183 | 9/1986 | Ulmer | 256/1 |
| 4,787,603 | 11/1988 | Norton | 256/1 X |
| 5,036,986 | 8/1991 | Kral | 211/20 X |
| 5,078,277 | 1/1992 | Tschritter | 211/20 |
| 5,201,426 | 4/1993 | Cruwell, Jr. | 211/17 |
| 5,267,657 | 12/1993 | McGuiness et al. | 211/22 |
| 5,279,085 | 1/1994 | DiPaolo et al. | 52/33 |

FOREIGN PATENT DOCUMENTS

| | | | |
|---|---|---|---|
| 2850763 | 5/1979 | Germany | 211/22 |
| 4200861 | 7/1993 | Germany | 194/905 |

OTHER PUBLICATIONS

"Collection and Return Trolleys," at ASDA lots, 2 Figures.

Covered Shopping Cart Corrals, at Catena (Denmark) lots, 2 Figures.

Covered Shopping Cart Corrals and "Trolleys," at Tesco lots, 4 Figures.

Shopping Cart Corrals (Some with descriptive signs and/or adjoining rubbish containers), at Sainsbury (U.K.) lots, 11 Figures.

Shopping Cart Storage and Retrieval Corrals and "Trolley Park," at Safeway (U.K.) lots, 4 Figures.

Shopping Cart Storage Corrals, at C.I.C.A. (Italy) lots, 4 Figures.

Speigle (France), Shopping Cart Corral, at unknown lot, 1 Figure.

Wanzl (Germany), Close–up of Shopping Cart Corral, 1 Figure.

Wanzl (Germany), Covered Shopping Cart Corrals, 4 Figures.

Covered Shopping Cart Storage and Retrieval Corrals, "A & P," Sav–a–Centre Food Market and Buggy Return, at A & P (Canada) lots, 3 Figures.

McCue Corporation, "Cart Return Station," at Leedmark lots, 3 Figures.

Media Shopping (France), Covered Shopping Cart Corrals, at Carrefour lots, 16 Figures (4 Figures on each of four sheets).

Media Shopping (France), Covered Shopping Cart Corrals (Some with Advertisements), 7 Figures.

National Cart, "Cart Corral," at Hannaford Bros. lots, 2 Figures.

National Cart, "Cart Station," at Carrefour lots, 4 Figures.

National Cart, "Pick Up Your Cart Here," at Finast lot, 1 Figure.

National Cart, Return Cart Corrals at various lots, 4 Figures.

National Cart, Shopping Cart Corral, at Stop & Shop lot, 1 Figure.

(List continued on next page.)

*Primary Examiner*—Robert W. Gibson, Jr.
*Assistant Examiner*—Brian J. Hamilla
*Attorney, Agent, or Firm*—Lahive & Cockfield

[57] ABSTRACT

A shopping cart station has flee-standing first and second hollow wall members filled with a ballast material. A connecting element couples the first and second hollow wall members together. The cart station can be easily moved and secured by emptying the hollow wall elements of the ballast material, repositioning the cart station, and refilling the wall members with ballast.

38 Claims, 5 Drawing Sheets

OTHER PUBLICATIONS

National Cart, Storefront and Covered Shopping Cart Corals, at Price Chopper lots, 4 Figures.

National Cart for McCue Corporation, "Cartsave Cart Stations" (Description of 3 Bay Single Entry Station and 6 Bay Double Entry Station), 1 Figure.

National Cart for McCue Corporation "Cartsave Covered Cart Corrals" (Advertisement), 1 Figure.

National Cart for MCue Corporation, Drawing of Cart Station with Canvas Tie Down Detail, 1 Figure (with inset).

Oshawa, "Shopping Carts; Pick–Up & Return Here," at Price Chopper (Canada) lot, 1 Figure.

SHOPPING CART STORAGE AND CONTROL STATION

BACKGROUND OF THE INVENTION

Shopping cart control and storage is a problem in the parking lots of many shopping areas. The problem stems from customers abandoning carts after they have taken the carts from the store to their vehicles for unloading. To avoid damage to customer's vehicles and to the shopping cans themselves, as well as to prevent clogging of parking spaces and thoroughfares, it has become common practice to provide can corrals or storage areas spaced throughout the parking lot in an effort to encourage customers to return the cans. Store employees or customers on their way into the store can then retrieve the carts from these storage areas.

The cart corrals commonly in use are, as the name implies, metal, fence-like structures. The metal from which cart corrals are typically made has a number of drawbacks. It is likely to rust and deteriorate, limiting the useful life of the corral and discouraging patrons from using it by its unattractiveness and potential to damage clothing. In the event that a car door is opened into a metal corral, both the car and the corral are likely to be damaged. Visibility of such open, fence-like structures is low, which further deters customers from using them.

Cart corrals as presently constructed are often permanently installed in parking lots. In areas of the country where snow is common, such open corrals may go unplowed, preventing customers from employing them. In other cases, cart corrals may be left freestanding, subject to movement by shifting weather patterns or accidental collisions.

It is therefore a primary object of the present invention to provide an improved storage facility for controlling shopping carts in a parking lot or large area. Other objects and advantages of the present invention reside in the provision of an improved protected storage area for shopping carts which is economical to manufacture, and easy to ship and install. The present invention has further advantages in that it is non-destructive, highly visible, durable in use, and attractive to the customer.

SUMMARY OF THE INVENTION

The present invention is directed to a shopping cart storage and control station for installation in a parking lot or other large area. The shopping cart station has a pair of free-standing, elongated, hollow wall members filled with ballast. The hollow wall members are preferably joined by a connecting member, which may be a rigid stop bar or chain to prevent carts from rolling out one end. Alternatively, the connecting member may be a threshold for preventing carts from rolling out the entrance of the storage station. More than one connecting member may be advantageous in the practice of the present invention, for example, where a stop bar and threshold are used.

The hollow walls are preferably formed of a rigid plastic or fiberglass, and the ballast is preferably water, although sand, gravel or other such weighted material may be used. The cart station of the present invention has the advantage of being highly visible, particularly if brightly colored, encouraging patrons to use it. While extremely stable when filled with ballast, the storage station of the present invention may be easily drained for moving or storage.

Optionally, the shopping cart station may include one or more signs to improve visibility, or include a roof to protect the shopping carts from rain or snow, and to prevent snow accumulation. The cart station may also be fitted with panels above, between, or against the wall members. Such panels may be clear or opaque and are useful for posting instructions or advertising, and as a weather shield.

The hollow wall members are preferably constructed of a substantially rigid plastic, which may be molded, recycled, composite, or fiber-reinforced plastic. Particularly preferred materials include molded polyethylene and fiberglass. This construction thereby avoids the disadvantages of previous cart corrals in that it is highly visible, does not rust, and is not likely to cause damage to a vehicle or cart upon impact. Moreover, the cart station is highly stable, yet will "give" or flex if inadvertently bumped by a vehicle to absorb a portion of the force of the impact, preventing damage to the cart station itself, to the customer's vehicle, and to the customer's property.

In the preferred embodiment, each wall member has a ballast compartment defined by the bottom and two side walls of the hollow wall member, and is adapted to receive at least one upright, such as for a sign or the support structure for a roof. The walls are preferably broader at the base for greater stability. This broader portion also prevents shopping carts from contacting and gauging the upper portion of the cart station, which is more likely to come in contact with a customer or the customer's property.

Novel features which are believed to be characteristic of the invention are set forth with particularity in the appended claims. For a fuller understanding of the nature and objects of the invention, reference should be made to the following detailed description taken in connection with the accompanying drawings, in which it will be seen that the objects set forth above, including those made apparent from the preceding description, are efficiently attained. Since certain changes may be made in the above construction without departing from the scope of the invention, is intended that all matter contained in the above description or shown in the accompanying drawings shall be interpreted as illustrative and not in a limiting sense.

DETAILED DESCRIPTION

Figure 1:
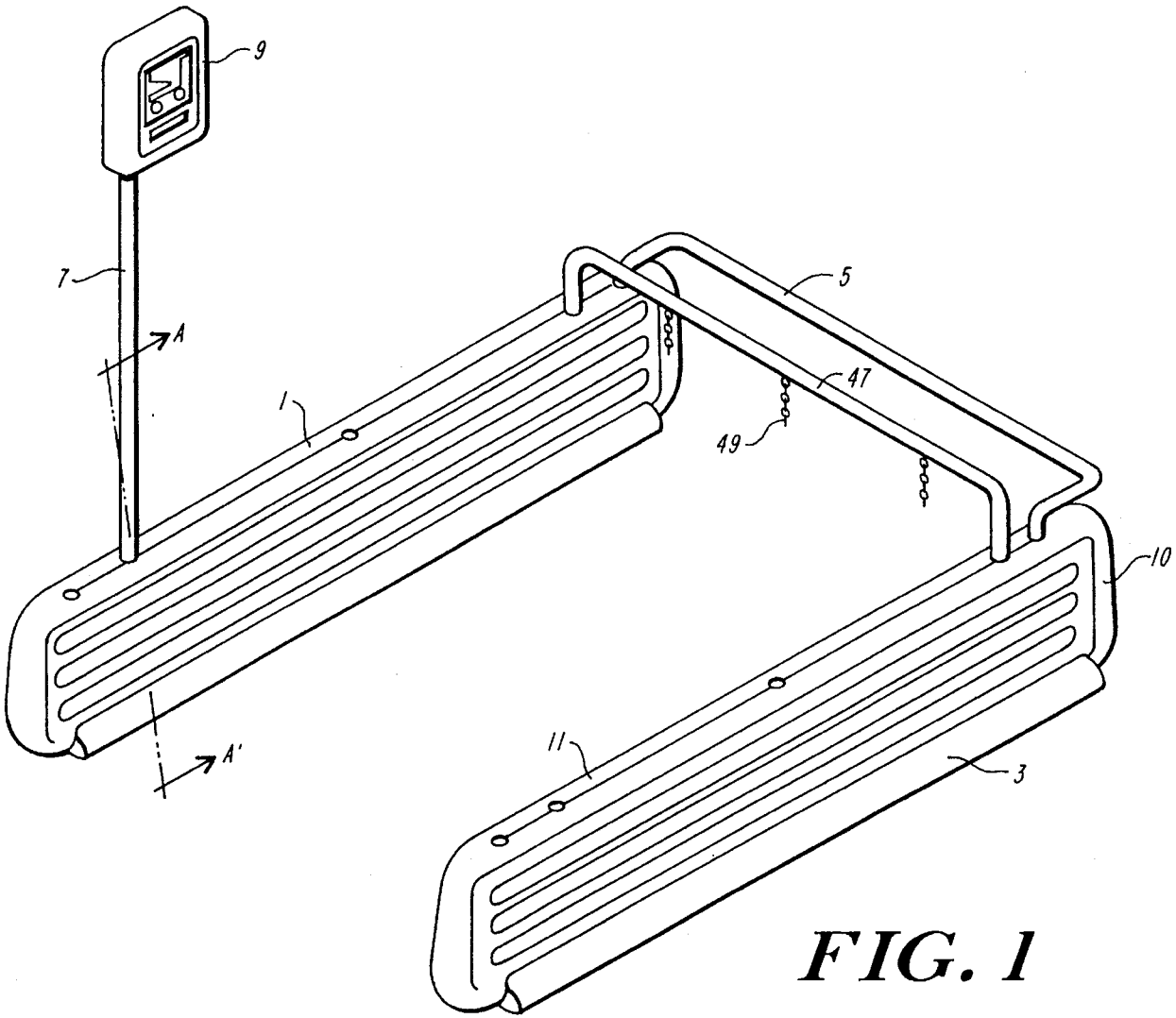
FIG. 1 is a top and front perspective view of a can control station of the present invention.

Referring to the Figures of the drawing, wherein like reference numerals designate corresponding parts, FIG. 1 illustrates a shopping cart station 10 having a pair of wall members 1 and 3 joined by connecting member 5, and a locating sign 9 atop an upright 7. Shopping cans are placed between the elongated wall members 1, 3 for storage purposes. Wall members 1, 3 can be oriented in any fashion relative to each other, but generally wall members 1, 3 are oriented parallel to each other to maximize storage space for shopping carts.

Each wall member 1, 3 has at least one chamber or recess 11 for receiving and securing one or more uprights 7 in a substantially vertical position. Uprights 7 are formed of a rigid material, such as metal or plastic. Preferably, upright 7 contains an aluminum alloy which prevents upright 7 from deforming over time. The uprights serve multiple purposes, one of which is to support signs at a height exceeding nearby obstructions. This allows customers to read the signs and locate the cart station from a distance, despite any intervening obstacles.

Connection means 5 is formed of either a single unitary piece or multiple interconnected pieces, as in a linked chain. Furthermore, connection means 5 can be either a rigid or flexible member. But in general, connecting means 5 comprises an elongated member having at least two ends, each of which is secured to wall members 1, 3 by any means known in the art. In one embodiment, connecting member 5 is placed on top of wall members 1, 3 where it additionally serves as a stop bar for preventing carts from exiting the station. Alternatively, connecting member 5 can be attached to the bottom surface of wall members 1, 3 where it acts as a threshold barrier for preventing carts from rolling out the entrance of the cart station. Connecting member 5 may also stabilize and prevent wall members 1, 3 from shifting or tipping over during installation or otherwise. This invention is not limited to the use of a single connecting member 5. Rather, the invention envisions multiple connecting members spanning wall members 1, 3 with each connecting member potentially serving different purposes, similar to the purposes described above.

Figure 2:
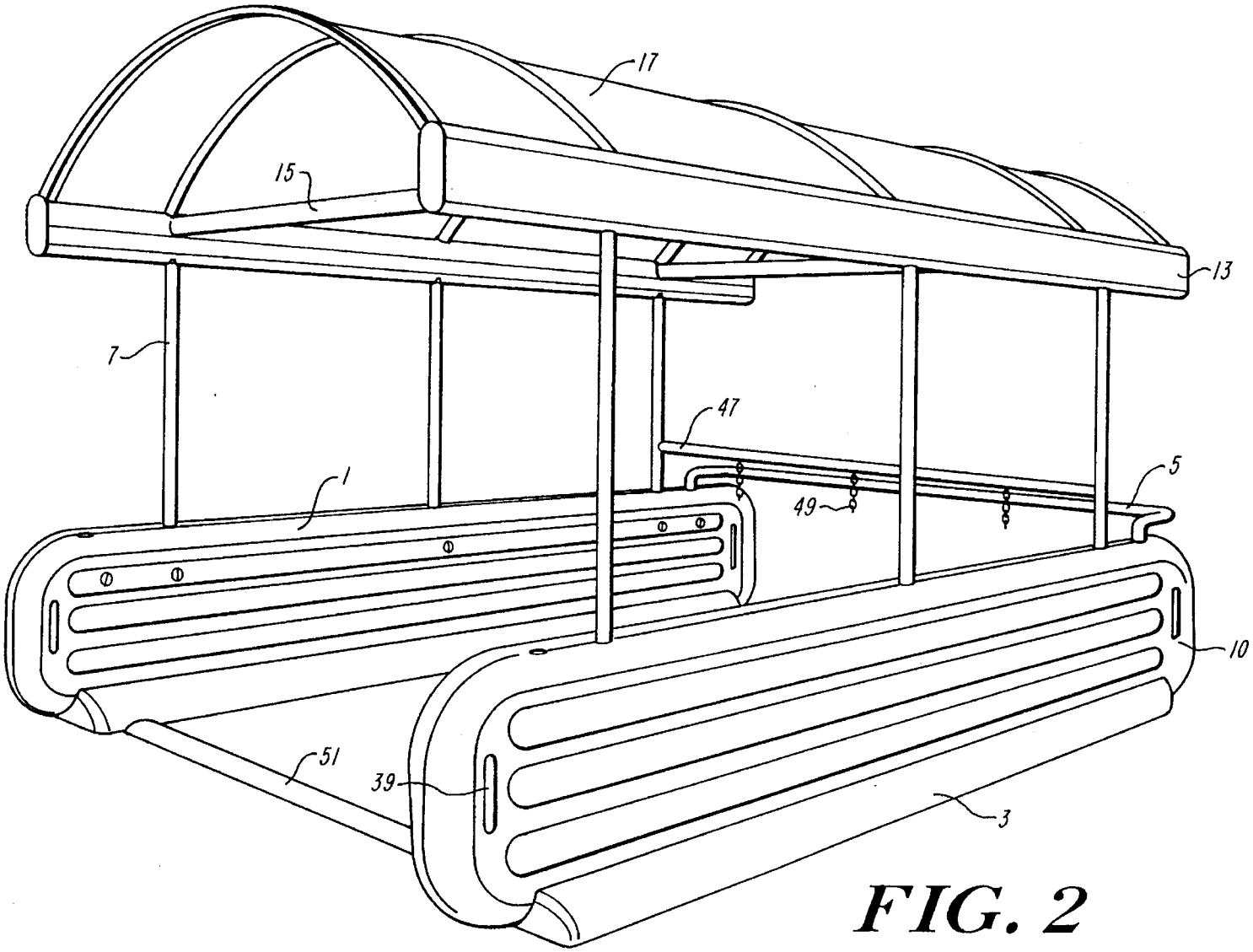
FIG. 2 is a side and front perspective view of a shopping cart corral of the present invention fitted with a root.

As illustrated in FIG. 2, cart station 10 may be fitted with a roof structure 13, attached to uprights 7. In one embodiment, roof structure 13 includes cross-beams 15 and a spanning element 17. Roof structure 13 protects customers and shopping carts from various environmental factors, including precipitation, wind, and excessive sun. Spanning element 17 may be clear or opaque, depending upon the amount of sunlight desired within cart station 10. Roof structure 13 may also serve as a place to attach posters and other means of communication.

Figure 3:
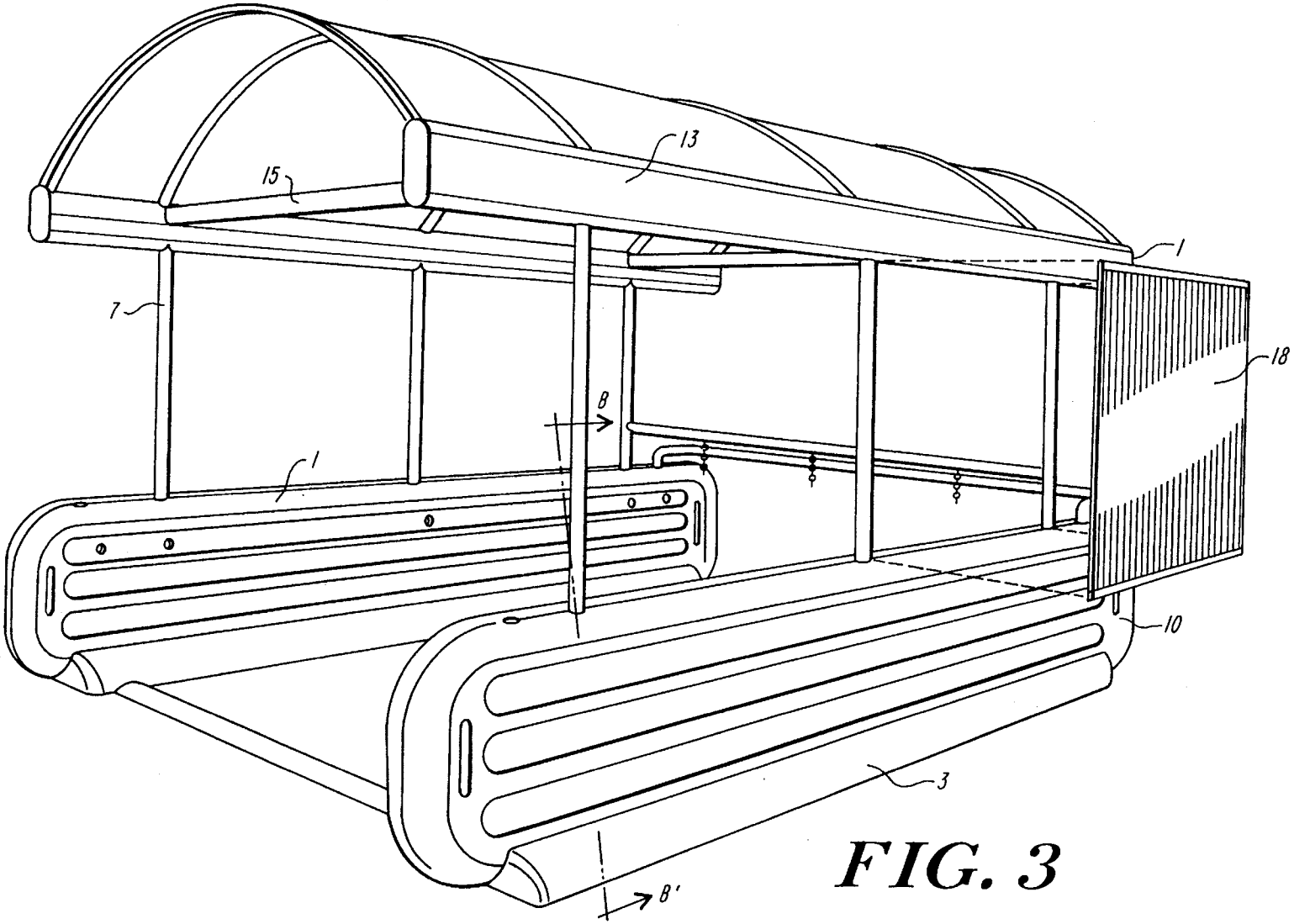
FIG. 3 is a top and front perspective view of a shopping cart corral of the present invention fitted with a panel.

FIG. 3 illustrates a shopping can station 10 having wall members 1, 3, upright 7, connecting means 5 and panel 18. Panel 18 is secured to one or more uprights 7 in a substantially vertical position. The panel may either rest against wall members 1, 3 or it may be raised above the level of wall members 1, 3. Panel 18 protects the cans and customers within cart station 10 from environmental factors, including wind and precipitation, existing outside cart station 10. Additionally, panel 18 serves as a place to attach posters and other means of communication.

Figure 4B:
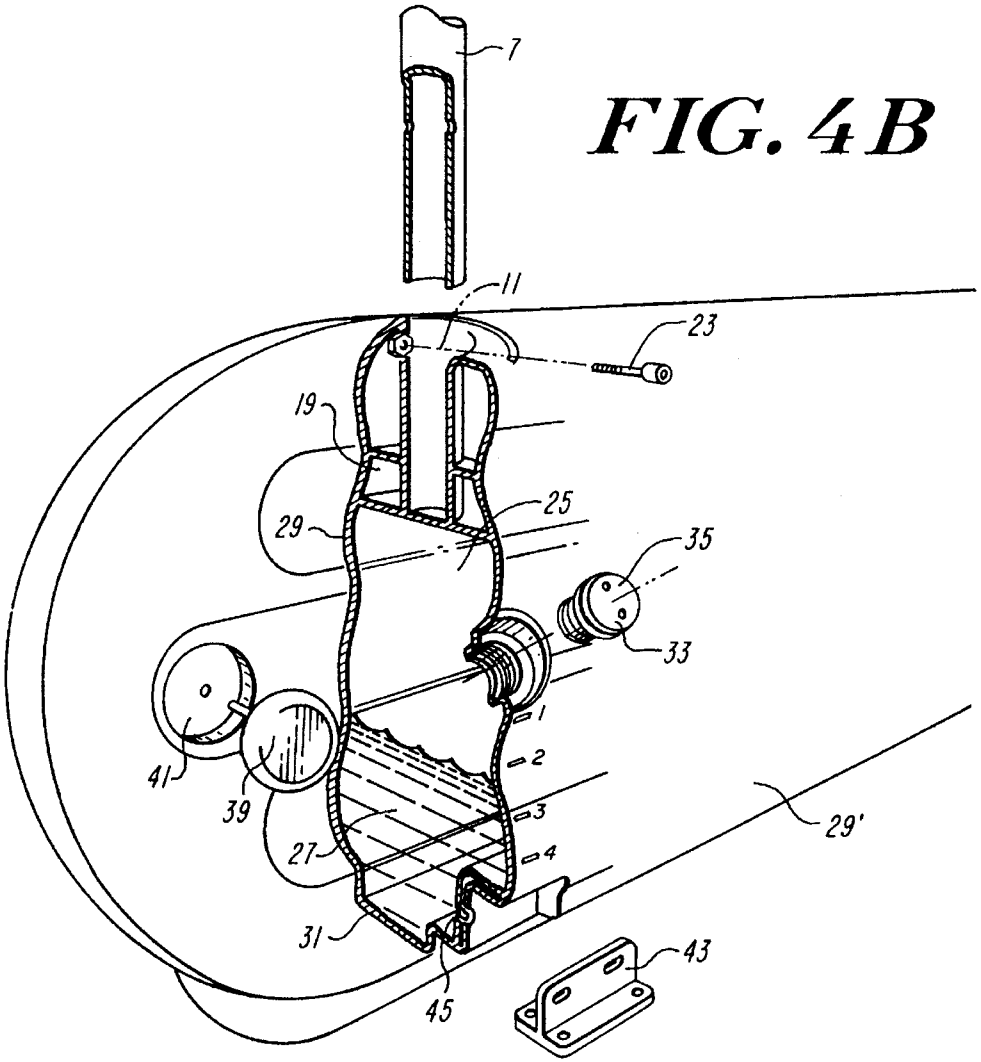
FIG. 4B is an alternative cutaway view taken along the line B—B' of FIG. 3 in the direction of the arrows, where the front portion of the side wall is ghosted to illustrate the inter-engagement of the parts of the cart control station, and showing an alternative reflector system, a mounting plate, and access port.
Figure 4A:
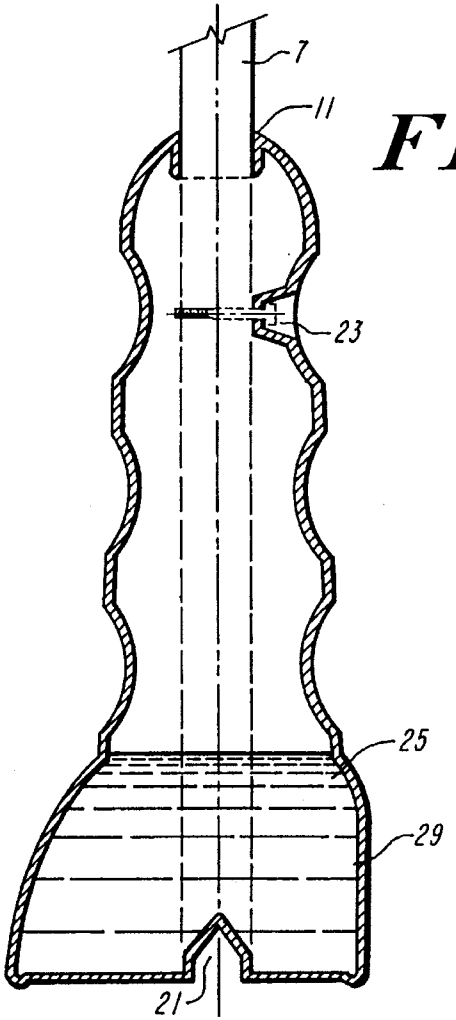
FIG. 4A is a cutaway view taken along the line A—A' of FIG. 1 in the direction of the arrows.

As is illustrated in FIG. 4A and 4B, wall members 1, 3 of the present invention have a recess 11 for receiving and securing upright 7. Recess 11 is substantially vertical and varies in depth; recess 11 may end just below the top surface of wall members 1, 3, as shown in FIG. 4B, or may extend through the entire height of wall members 1, 3, as shown in FIG. 4A. Recess 11 may be reinforced anywhere along its length by reinforcement member 19. In a one embodiment, illustrated in FIG. 4B, reinforcement 19 comprises a steel beam substantially transverse to recess 11. Preferably, upright 7 is secured in recess 11 at several points by any means known in the art, here illustrated by dimple 21 and bolt 23.

Wall members 1, 3 of the present invention define a ballast compartment 25 for holding ballast 27. Preferably, ballast compartment 25 comprises the interior of hollow wall members 1, 3, as defined by side walls 29 and 29' and bottom surface 31. According to one aspect of this invention, the upper portions of side walls 29 are closer together than the lower portions of side walls 29. The increased width at the base of wall members 1, 3 increases their stability and the effectiveness of ballast material 27.The bottom surface 31 of hollow wall members 1, 3 are surface ready. For example, the hollow wall members 1, 3 may be readily placed in a parking lot.

Preferably, ballast material 27 is easily removed from ballast compartment 25 and easily replaced. Potential ballast 27 includes: (1) crushed solid matter such as gravel, sand, concrete, or rocks; or (2) liquid matter such as water. A liquid ballast is advantageous as it flows evenly through the ballast compartment, providing uniform stability. If a liquid ballast is used in cold climates, additives such as antifreeze may be desirable. Ballast 27 provides added weight to can station 10, thereby stabilizing and securing station 10 in its selected location. Ballast 27 is added to wall members 1, 3 via access port 33, which is fitted with cover 35. Cover 35, if fitted with drainage holes 37, also serves as drain means. A separate drain means, not shown, may be employed.

Side wall 29, preferably having a scalloped shape in cross-section and grooves running substantially perpendicular to lines A–A' or B–B', reinforces wall members 1, 3. As shown in FIGS. 4A and 4B, the corrugated surface of side wall 29 distributes the weight of ballast 27, thereby preventing warping of wall members 1, 3. Reinforcement member 19 also strengthens wall members 1, 3 to prevent any undesired distortions of the structure.

Safety features include one or more reflectors 39, fitted into recess 41 on the side wall of the hollow wall members 1, 3. A further safety feature, in the form of a mounting plate 43 for securing hollow wall members 1, 3 to the surface of the parking lot, may be used for extra stability. While the weight of walls 1, 3 filled with ballast 27 renders cart station 10 extremely stable and resistant to movement from accidental door openings or other vehicle impact, in hilly areas mounting plate 43 provides added security. Mounting plate 43 may be secured directly to the side wall 29 of wall members 1, 3 or, preferably, is fitted into a recess 45 at the base of side wall 29, and secured by means known in the art, including screws, bolts, adhesive, and nails. Recess 45 may also be used to secure connecting member 5 when attached to the bottom surface of wall members 1, 3.

Further optional elements include connecting member 5 in the form of securing bar 47, to which shopping cart locking systems 49, such as those manufactured by McCue Corporation, are attached. Dimple 21 and mounting plate recess may also be used to connect another embodiment of connecting member 5, specifically, threshold 51.

Figure 5:
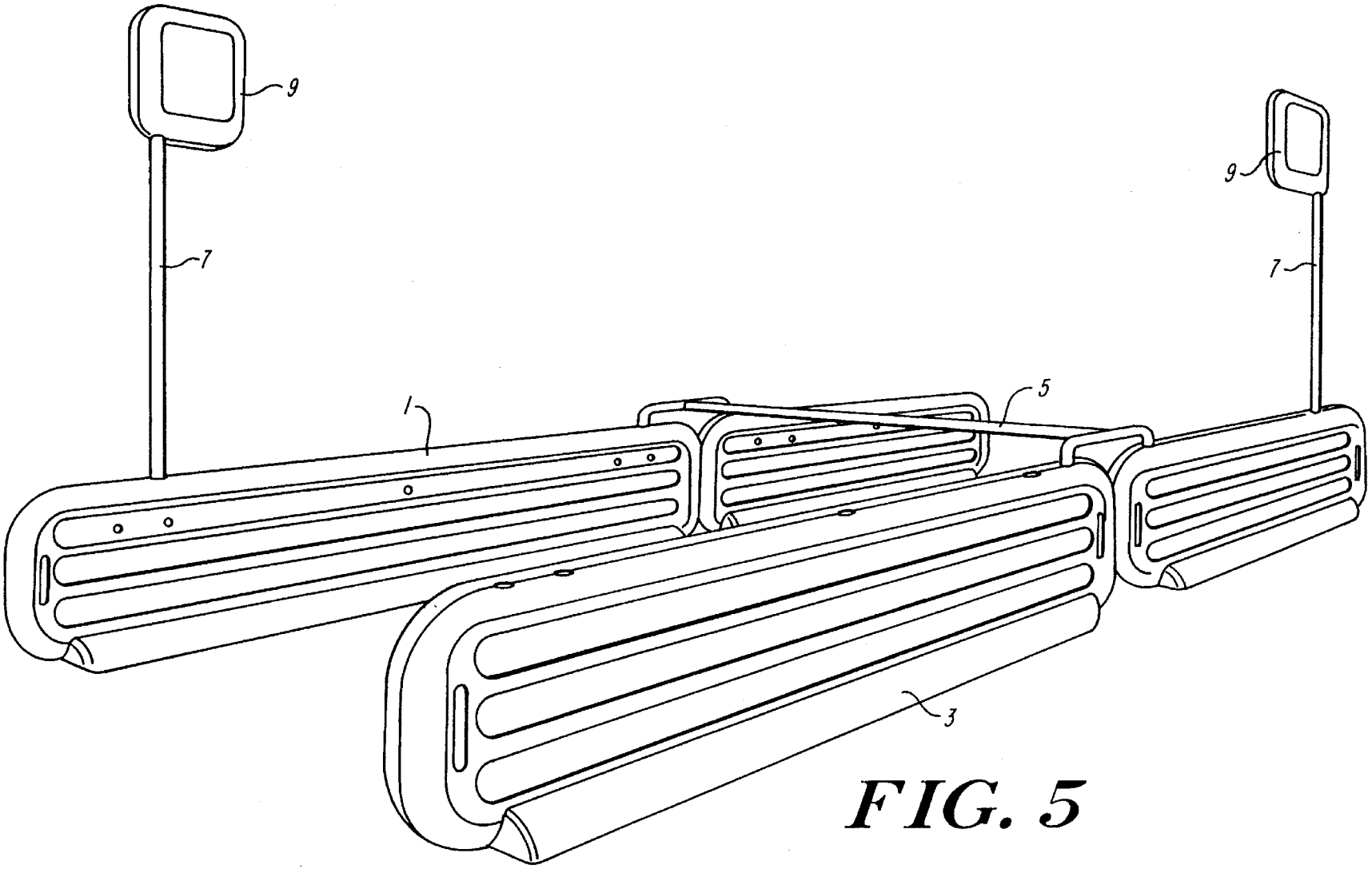
FIG. 5 is an alternative embodiment of the of the present invention showing a double shopping cart corral.

Cart control stations of the present invention may comprise a single pair of wall members, as shown in FIG. 1, or they may comprise multiple pairs of wall members. FIG. 5 illustrates a cart control station having two pairs of wall members 1, 3, double connecting member 5, and two locating panels. As illustrated in FIG. 5, connecting member 5 secures both pairs of wall members 1, 3. Two locating panels 9, 9', aid a customer in visibly locating the cart control station.

Equivalents

Those skilled in the art will recognize, or be able to ascertain using no more than routine skill and knowledge, numerous equivalents to the specific elements described herein. Such equivalents are considered to be within the scope of this invention and are covered by the following claims. It is also to be understood that the following claims are intended to cover all of the generic and specific features of the invention, which, as a matter of language, might be said to fall there between.

What is claimed is:

1. A shopping cart station for storage of shopping carts, said shopping cart station comprising:

freestanding first and second hollow wall members each having first and second side walls connected to a bottom surface, wherein said first and second side walls have an upper portion and a lower portion, said upper portions of said first and second side walls are separated by a first distance, said lower portions of said first and second side walls are separated by a second distance, and said first and second side walls are elongated along a first axis, connecting means coupling said first hollow wall member to said second hollow wall member, and a ballast compartment defined by said first side wall, said second side wall and said bottom surface of said first hollow wall member, wherein said first axis is substantially horizontal, and wherein said first and second hollow wall members are adapted for storing carts therebetween.

2. A shopping cart station according to claim 1 further comprising ballast means contained within said ballast compartment of first hollow wall member for stabilizing said first hollow wall member.

3. A shopping cart station according to claim 2 wherein said ballast means is removable and replaceable.

4. A shopping cart station according to claim 3 wherein said first hollow wall member further comprises draining means for removing said ballast means from said first hollow wall member.

5. A shopping cart station according to claim 1 having access means for filling said ballast compartment.

6. A shopping cart station according to claim 2 wherein said ballast means is selected from the group consisting of liquid, sand, and gravel.

7. A shopping cart station according to claim 1 wherein said first hollow wall member is formed of plastic.

8. A shopping cart station according to claim 7 wherein said plastic is selected from the group consisting of molded, recycled, composite, and fiber-reinforced plastic.

9. A shopping cart station according to claim 1 wherein said first hollow wall member is formed of fiberglass.

10. A shopping cart station according to claim 1, said shopping cart station further comprising a first upright secured to said first hollow wall member.

11. A shopping cart station according to claim 10, said shopping cart station further comprising a panel member attached to said first upright means.

12. A shopping cart station according to claim 10, said shopping cart station further comprising a second upright means secured to said second hollow wall member, and a roof means disposed on said first and said second uprights.

13. A shopping cart station according to claim 1 wherein said bottom surface of said first hollow wall member is surface ready.

14. A shopping cart station according to claim 1, wherein said second distance between said lower portions of said first and second side walls is greater than said first distance between said upper portions of said first and second side walls.

15. A shopping cart station according to claim 1, wherein said lower portions of said first and second side walls of said ballast compartment are outwardly bowed.

16. A shopping cart station according to claim 1 further comprising mounting means for connecting said first hollow wall member to a parking lot.

17. A shopping cart station according to claim 1 further comprising reinforcing means for preventing warping of said first hollow wall member.

18. A shopping cart station according to claim 17 wherein said reinforcing means comprises a steel beam element contained within said first hollow wall member and lying substantially parallel to said first axis.

19. A shopping cart station according to claim 17 wherein said reinforcing means comprises said first side wall having a corrugated surface having grooves lying substantially parallel to said first axis.

20. A shopping cart station according to claim 1 wherein said connecting means comprises a threshold bar attached to said bottom surface of said first and second hollow wall members.

21. A shopping cart station according to claim 1 wherein said connecting means comprises a stop bar attached to said first and second hollow wall members.

22. A shopping cart station for storage of shopping carts, said shopping cart station comprising first and second hollow wall members each elongated along a first axis and having a bottom surface, a connecting means coupling said first hollow wall member to said second hollow wall member, and a ballast means contained within said first hollow wall member for stabilizing said first hollow wall member, wherein said first axis is substantially normal to horizontal, and wherein said first and second hollow wall members are arranged relative to one another to hermit storage of at least one shopping cart therebetween.

23. A shopping cart station according to claim 22 wherein said ballast means is removable and replaceable.

24. A shopping cart station according to claim 23 wherein said first hollow wall member further comprises draining means.

25. A shopping can station according to claim 23 having access means for access means for filling said first hollow wall member with said ballast means.

26. A shopping can station according to claim 23 wherein said ballast means is selected from the group consisting of water, sand, and gravel.

27. A shopping cart station according to claim 22 wherein said first hollow wall member is formed of plastic.

28. A shopping cart station according to claim 27 wherein said plastic is selected from the group consisting of molded plastic, recycled plastic, composite plastic, and fiber-reinforced plastic.

29. A shopping cart station according to claim 28 wherein said plastic is polyethylene.

30. A shopping cart station according to claim 22 wherein said first hollow wall member is formed of fiberglass.

31. A shopping cart station according to claim 22 wherein said bottom surface of said first hollow wall member is surface ready.

32. A shopping cart station according to claim 22 further comprising mounting means for securing at least one of said first and second hollow wall members to a parking lot.

33. A shopping cart station according to claim 22 further comprising a reinforcing means for prevent warping of said first hollow wall member.

34. A shopping cart station according to claim 33 wherein said reinforcing means comprises a steel beam element contained within said first hollow wall member and lying substantially parallel to said first axis.

35. A shopping cart station according to claim 33 wherein said reinforcing means comprises a corrugated surface having grooves lying substantially parallel to said first axis.

36. A shopping can station according to claim 22 wherein said connecting means comprises a threshold bar attached to said bottom surface of said first and second hollow wall members.

37. A shopping cart station according to claim 22 wherein said connecting means comprises a stop bar attached to said first and second hollow wall members.

38. A shopping cart station for storage of shopping carts in a store parking lot, said shopping cart station comprising:

first and second hollow wall members, connecting means coupling said first wall member to said second wall member, removable and replaceable ballast means contained within said first wall member for stabilizing said first wall member, roof means disposed on substantially vertical first and second uprights secured to said first wall member and said second wall member, access means for filling said first wall member with said ballast means, and draining means for removing said ballast means from said first hollow wall member.

* * * * *

UNITED STATES PATENT AND TRADEMARK OFFICE

CERTIFICATE OF CORRECTION

PATENT NO. : 5,551,578

DATED : September 3, 1996

INVENTOR(S) : David S. McCue and Roland M. Gebhardt

It is certified that error appears in the above-indentified patent and that said Letters Patent is hereby corrected as shown below:

On the title page, item 57,
please replace "flee-standing" with --free-standing--;

At column 1, line 9, please replace "shopping cans" with --shopping carts--;

At column 1, line 13, please replace "can corrals" with --cart corrals--;

At column 1, line 14, please replace "the cans" with --the carts--;

At column 2, line 42, please replace "a can control" with --a cart control--;

At column 2, line 46, please replace "with a root:" with --with a roof.--;

At column 2, line 66, please replace "shopping cans" with --shopping carts--;

At column 3, line 45, please replace "shopping can" with --shopping cart--;

UNITED STATES PATENT AND TRADEMARK OFFICE

CERTIFICATE OF CORRECTION

PATENT NO. : 5,551,578
DATED : September 3, 1996
INVENTOR(S) : David S. McCue and Roland M. Gebhardt It is certified that error appears in the above-indentified patent and that said Letters Patent is hereby corrected as shown below:

At column 3, line 50, please replace "protects the cans" with --protects the carts--;

At column 4, line 20, please replace "can station 10" with --cart station 10--; and At column 7, line 8, please replace "can station" with --cart station--.

Signed and Sealed this

Fifth Day of August, 1997

Bruce Lehman

*Attest:*

BRUCE LEHMAN

*Attesting Officer*

*Commissioner of Patents and Trademarks*